United States Patent [19]

Volpe

[11] 4,332,376

[45] Jun. 1, 1982

[54] MECHANISM FOR STACKING SEQUENTIALLY RECEIVED SHEETS

[75] Inventor: Richard L. Volpe, Hopedale, Mass.

[73] Assignee: White Consolidated Industries, Inc., Cleveland, Ohio

[21] Appl. No.: 132,317

[22] Filed: Mar. 20, 1980

[51] Int. Cl.[3] ..... B65H 31/10; B65H 31/20

[52] U.S. Cl. ..... 271/217; 414/98; 414/900

[58] Field of Search ..... 414/98, 100, 900; 271/147, 157, 214, 215, 217, 218

[56] References Cited

U.S. PATENT DOCUMENTS

| | | | |
|---|---|---|---|
| 1,145,921 | 7/1915 | Rich | 414/98 |
| 1,358,152 | 11/1920 | Hildebrand | 414/98 X |
| 1,605,983 | 11/1926 | Podel | 271/215 |
| 1,689,729 | 10/1928 | Kelly | 271/157 |
| 2,393,254 | 1/1946 | Leifer | 271/217 |
| 2,894,745 | 7/1959 | Holmes et al. | 271/147 |

FOREIGN PATENT DOCUMENTS

| | | | |
|---|---|---|---|
| 268934 | 4/1927 | United Kingdom | 271/215 |

*Primary Examiner*—Leslie J. Paperner

*Attorney, Agent, or Firm*—Pearne, Gordon, Sessions, McCoy & Granger

[57] ABSTRACT

Serially flowing, conveyor-transported, horizontal sheets are sequentially dropped from a vertically fixed location atop one another onto a chain-supported stacking table incrementally lowered, by a distance equal to the thickness of a sheet, in synchronism with the rate of sheet delivery to the table. An adjustment mechanism is provided to exactly match the incremental distance of table lowering to the thickness of the sheets being stacked. A reciprocating link actuating a ratchet-type drive incrementally lowers the table, while a manual crank mechanism permits rapid raising of the table subsequent to the off-loading of a stack of sheets. The disclosed mechanism finds particular application as a pile stacker at the delivery end of an offset printing press.

9 Claims, 5 Drawing Figures

FIG. 2
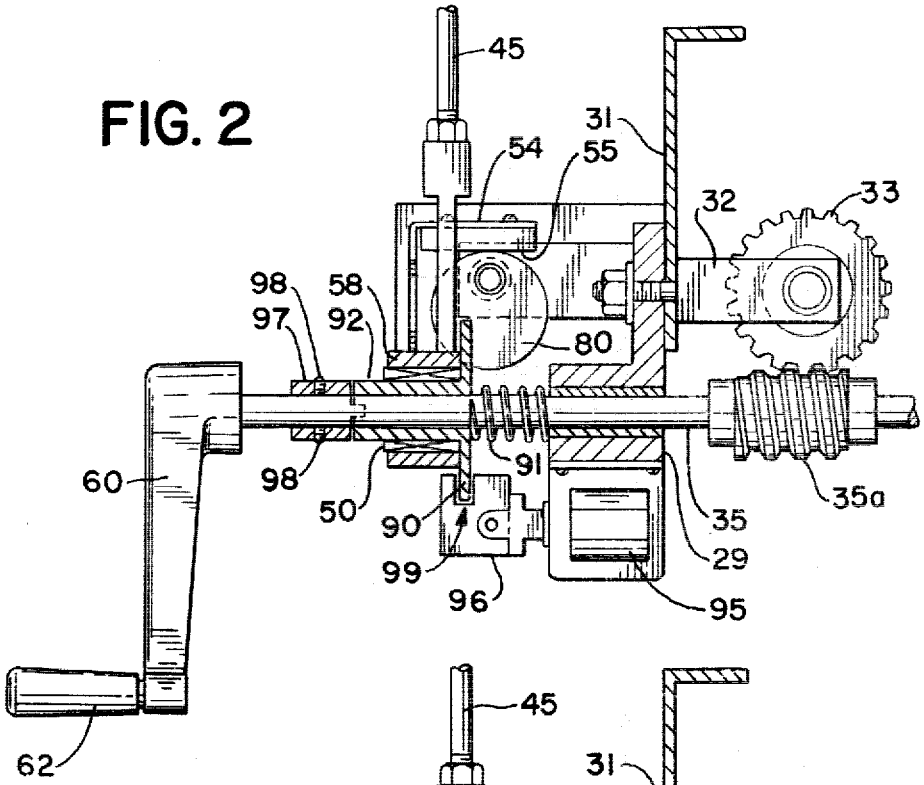
FIG. 3
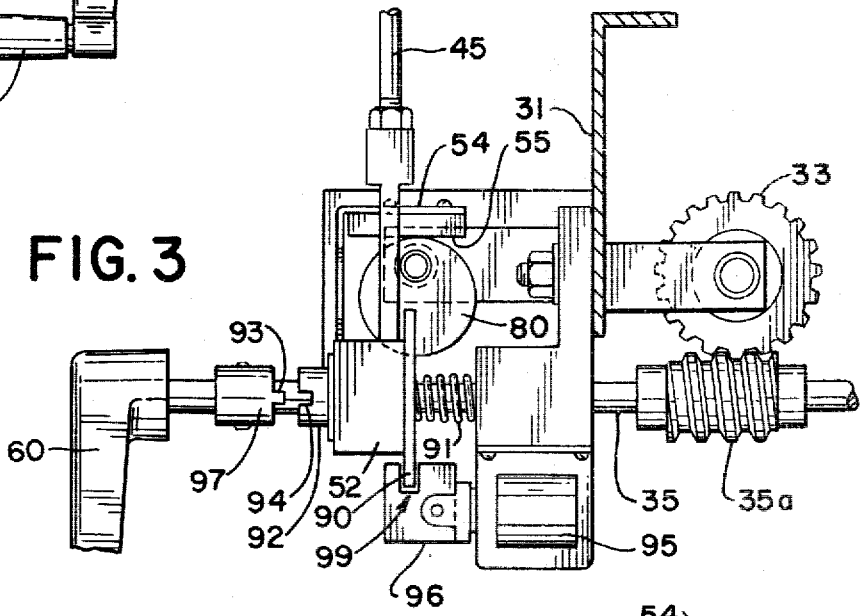
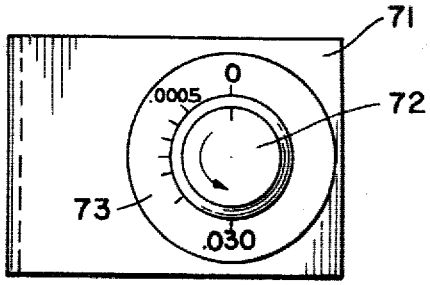
FIG. 4
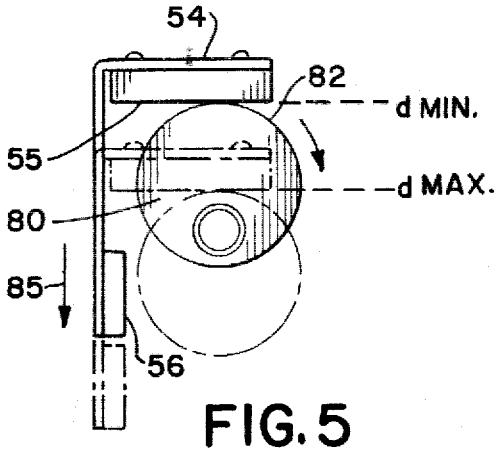
FIG. 5

MECHANISM FOR STACKING SEQUENTIALLY RECEIVED SHEETS

BACKGROUND OF THE INVENTION

The present invention relates in general to material handling devices and, more particularly, to a pile stacker for an offset printing press sequentially delivering at its output end printed sheets of paper.

Prior art pile stackers for offset printing presses or the like rely on complex mechanical, electromechanical, or hydraulic mechanisms in an attempt to provide accurate incremental lowering of the sheet-receiving pile stacker table, in accordance with the thickness of the sheets and the rate at which they are being stacked, in order to maintain the top of the stack of sheets at a constant level for the receipt of subsequent sheets fed from a vertically fixed location. The complexity of such mechanisms necessarily leads to high manufacturing costs and reliability problems.

Prior art mechanisms of the subject type are illustrated by the following U.S. Pat. Nos.:

2,795,420
2,861,805
3,008,710
3,516,658
3,905,595.

SUMMARY OF THE INVENTION

The present invention provides a simple and highly reliable mechanical mechanism particularly suited for use as a pile stacker for an offset printing press.

A sheet-receiving table connected to a spindle means is moved vertically by rotation of the spindle on its longitudinal axis. Reciprocating drive means rotates the spindle means in a first direction by a predetermined amount less than a complete revolution for each reciprocation cycle of the drive means to incrementally lower the table.

In accordance with the invention, the drive means includes a one-way, rachet-action clutch, preferably of the roller bearing type, journaled on the spindle means and a reciprocating lever arm fixed to the clutch and extending radially from the axis of rotation of the spindle means. Reciprocating movement of the lever arm is translated by the clutch into one-way incremental rotational movement of the spindle means to effect table lowering. Means are provided for raising the table from a lower position to a higher position.

Highly accurate dropping of the table at increments ranging from 0.030 inch to 0.0005 inch per cycle of the press is provided by an adjustment mechanism having a cam surface constituted by at least a portion of the outer periphery of at least a partially rotatable cam element. A cam follower connected to the reciprocating drive means is continuously biased toward the cam surface. Rotation of the cam varies, via the throw of the ratchet-action clutch, the degree of motion transfer between the reciprocating drive means, and the incrementally rotating spindle.

Preferably, the cam follower is fixed to the distal end of the lever arm. The cam surface constitutes an end stop functioning to limit the end travel of the reciprocating lever arm in the slip direction of the ratchet-action clutch.

BRIEF DESCRIPTION OF THE DRAWINGS

FIG. 2 is a partial cross-sectional view of a portion of the mechanism in an engaged table-lowering position;

FIG. 3 is an elevational view of a portion of the mechanism in its disengaged table-raising position;

FIG. 4 is an end view of an adjustment knob illustrated in FIG. 1; and

FIG. 5 illustrates the functioning of a camlike adjustment mechanism illustrated in FIG. 1.

Figure 1:
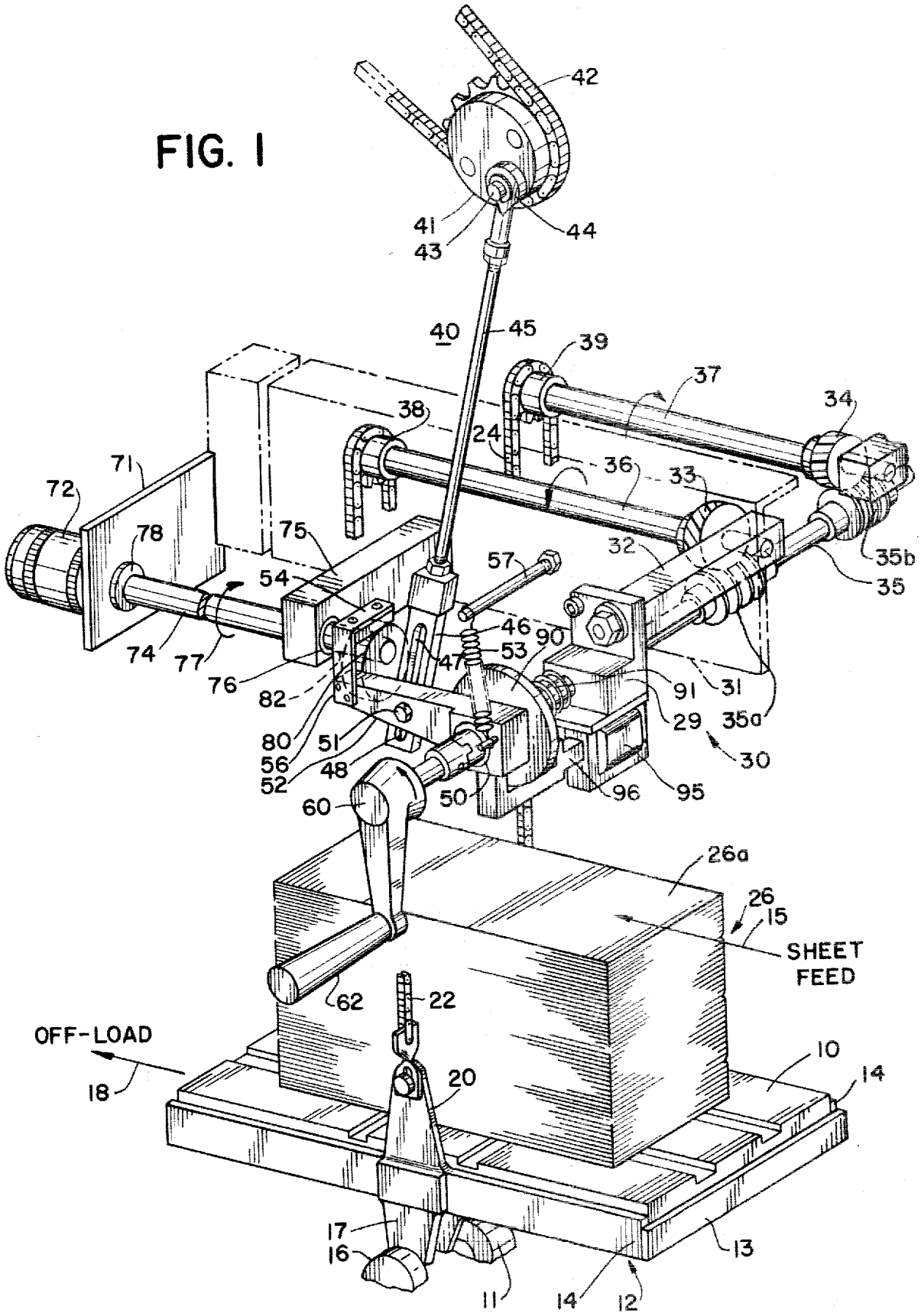
FIG. 1 is a perspective view of a mechanism constructed in accordance with the present invention.

DETAILED DESCRIPTION OF THE PREFERRED EMBODIMENT p With reference to FIG. 1, there is illustrated a generally horizontally extending stacking table 10, supported from below by stacking table wheels 11 (only one partially shown). The table 10, in a sheet-receiving position, is carried in a vertically movable, table-retaining carriage or frame 12 having an end stop member 13 and a pair of guide rail sides 14 (only one fully shown) formed of angle iron members, one leg of each of the angle iron members extending below the table to support it.

Serially flowing, conveyor-transported, horizontal sheets are sequentially dropped from a vertically fixed location atop one another, onto the stacking table. Where the present invention is utilized as a pile stacker for an offset printing press, a sheet feed arrow 15 illustrates the horizontal movement of the sheets as they are dropped or thrown off the end of the vertically fixed sheet delivery conveyor of the press. Conventional guides stop the horizontally moving sheets and align them from gravity-induced dropping onto the top **26*a* of a stack of sheets 26. The stacking table 10, carrying the stack of sheets 26, is incrementally lowered by a distance equal to the thickness of the sheets in synchronism with the rate of sheet delivery to the table to maintain the top 26*a* of the stack at a constant vertical level, the manner of lowering the table to be subsequently illustrated. When the table 10 reaches its lowermost position, i.e., when it rests on its wheels 11 with a complete stack of sheets, the stacking table 10 is pulled out and slidingly disengaged from the table-retaining carriage or frame 12 in a direction indicated by off-load arrow 18. An empty stacking table 10 is then reinserted into the table-retaining carriage or frame 12 until it abuts the end stop 13**, wherein the table is raised to a position for again receiving sheets.

In accordance with the present invention, the table 10 and the frame 12 on which it rides move up and down in a vertical direction as guided by a pair of conventional rollers 16 (only one shown) which ride in a pair of parallel, vertically extending, conventional guide channels (not shown). The rollers 16 are each mounted to a vertically extending guide roller supporting bracket 17, which in turn is fixed to a midportion of a respective one of the guide rail sides 14 of the table-retaining carriage 12. Extending vertically upward from the midportion of the guide rail sides 14 are a pair of respective lifting arms 20 (only one shown) having their distal uppermost ends connected to one end of a pair of table-supporting lifting chains 22, 24, the chains 22, 24 having then other ends attached to a take-up means such as conventional spiral-type springs which serve to take-up or let-out chain in accordance with the vertical position of the table 10.

The chains 22, 24 engage and are synchronously driven by a pair of rotating sprocket gears 38, 39, the synchronous movement of which will be discussed in detail subsequently.

With the table 10 in a raised position, it is incrementally lowered by the downward synchronous extension of the chains 22, 24 in an incremental, step-by-step manner to maintain the top 26*a* of the stacked sheets at a constant level for reception of subsequently fed sheets.

In accordance with the present invention, the mechanism illustrated in FIG. 1 includes a spindle means support bracket 29 fixed to a main frame member 31 and to one end of a bearing providing bracket 32 which extends perpendicularly to the direction of the sheet feed arrow 15. The main frame member 31 extends perpendicularly to the bearing providing bracket 32.

In accordance with the invention, an indexing spindle 35 is incrementally rotated on its longitudinal axis to cause step-by-step lowering of the table 10. The indexing spindle 35 includes a pair of worm gears 35*a*, 35*b* fixed to the spindle 35 and spaced apart axially from one another thereon. A pair of parallel, horizontally extending chain drive shafts 36, 37 having fixed at one end the sprocket gears 38, 39, and at the other end a pair of worm gear-engaging spur gears 33, 34 rotate in opposed directions, as indicated, to lower or raise the table 10. The illustrated spindle support block 29 serves as a bushing-type end support for journalling one end of the rotating spindle 35, the other end of the spindle 35 being supported by conventional means for rotation as are the ends of the drive shafts 36, 37, the chain drive shafts 36, 37 each having at least one of their ends supported and journaled by the bearing providing bracket 32, as indicated.

The imparting of incremental, step-by-step, rotational movement to the spindle 35 will now be discussed. A constant throw, eccentric-type, reciprocating drive 40, in a preferred form, includes a rotating sprocket member 41 driven by a drive chain 42, as illustrated. The sprocket member 41 includes an eccentrically offset or off-centered crank pin 43 upon which is mounted a self-aligning bushing 44 fixed to one end of a link rod 45. The link rod 45 has at its other end a slotted end member 46 having a lifter slot 47 that extends along the longitudinal axis of the link rod 45. Upon rotational movement of the sprocket member 41, the link 45 reciprocates or oscillates back and forth generally along its longitudinal axis.

Reciprocating motion of the link rod 45 is transferred to incrementally rotate the spindle 35 via a one-way ratchet action clutch 50 journaled on one end of the spindle 35 in a manner to be subsequently discussed in detail. Fixed to and extending radially from the axis of rotation of the clutch 50 and the spindle 35 is a lever arm 52 providing at its general midsection area a pin 51 which extends horizontally into and rides in the lifter slot 47. At the distal end 56 of the lever arm 52 there is provided a cam follower 54 which rides against and is biased toward a cam surface 82 provided by a rotatable eccentrically mounted cam member or element 80.

A lever arm return bias spring 53 is attached between a main frame anchored spring mounting pin 57 and the end of the lever arm opposite to the distal end 56. The spring is stretched in tension to apply rotational force to the lever arm 52 so as to bias the cam follower 54 against the cam surface 82, the axis of rotation of the spindle 35 acting as a lever arm pivot point, as illustrated.

In operation, rotation of the sprocket member 41 causes raising and lowering in reciprocal fashion of the slotted end member 46. With the slotted member 46 in its lowermost position, the pin 51 is spaced above the bottom 48 of the lifter slot 47. As the slotted end member 46 begins to raise, the lever arm 52 will remain in position biased against the cam surface 82, there being lost motion between the end member 46 and the pin 51. When the upwardly moving bottom 48 of the slot 47 engages the pin 51, the cam follower 54 is lifted upward off the cam surface 82 while the one-way clutch 50 rotates in a nonslip, clockwise direction to engage the spindle 35 and rotate it until the slotted end member 46 reaches its uppermost position dictated by the highest vertical position of the crank pin 43. As the slotted end member 46 begins to move downwardly, the clutch 50 rotates in a counterclockwise slip direction and the spindle 35 remains fixed in a non-rotating position. The pin 51 will continue to lower with the end member 43 until the cam follower 54 engages the cam surface 82, wherein the slotted end member 46 continues downward to its lowermost position for the start of another reciprocation cycle.

It can be seen that the spindle 35 rotates by a predetermined amount less than a complete revolution for each reciprocation cycle of the end member 46. It can further be seen that the cam surface 82 acts as an adjustable stop wherein rotation of the cam element 80 to vary the cam surface 82 changes the spacing between the slot bottom 48 at its lowermost position and the pin 51 to, in effect, vary the degree of lost motion between the link rod 45 and the spindle 35.

In accordance with the present invention, the cam element 80 is fixed to one end of a cam rotating shaft 74 having an adjustment knob 72 fixed to its other end. The cam rotating shaft 74 is rotatably supported and journaled at its ends by a bushing 78 (in turn supported by a bushing support member 71) and a oneway roller bearing clutch 76 (in turn supported by a clutch-supporting member 75). In accordance with the invention, the shaft 74 is rotatable in only one direction, as illustrated by arrow 77, wherein rotational-causing torque forces applied to the cam element 80 by the reciprocating cam follower 54 are always in a nonslip direction of the clutch 76 to maintain the cam element 80 at its preset position. This feature will be more fully illustrated with regard to FIG. 5.

It can be seen that reciprocating motion of the link rod 45 causes incremental step-by-step lowering of the table 10, due to the ratchet action of the clutch 50. Rotation of the cam element 80 varies, via the ratchet-action clutch 50, the degree of motion transfer between the reciprocating drive 40 and the incrementally rotating spindle 35 to accommodate different sheet thicknesses.

Turning to FIG. 2, there is illustrated in greater detail the mounting of the one-way clutch 50. A portion of the spindle 35 is illustrated as extending from the worm gear 35*a* to a table-raising handle 60 fixed to the spindle, the handle 60 including a crank arm 62.

A retracting flange 90 is journaled for free rotation and limited axial movement on the spindle 35. A bushing portion 92 of the flange 90 extends outwardly from the flange 90 in the direction of the handle 60 to engage a collar member 97 fixed to the spindle 35 by setscrews 98. Riding on the outer cylindrical surface of the bushing portion 92 of the flange 90 is the one-way, ratchet-action clutch 50, preferably in the form of a generally annular roller bearing clutch. Rotationally fixed to the outer diameter side of clutch 50 is a clutch-engaging portion 58 of the lever arm 52, discussed earlier. With rotation of the lever arm in one direction, such as a clockwise direction as illustrated in FIG. 1, the clutch 50 frictionally engages the flange bushing portion 92 and rotates the flange 90, which in turn rotates the engaged collar 97 fixed to the spindle 35. On opposite direction, counterclockwise rotation of the lever arm 52, the clutch 50 and the flange bushing portion 92 slip relative to each other. The positive engagement between the collar 97 and the bushing portion 92 of the flange 90 is ensured by a retracting flange bias spring 91 which exerts a continuous force against flange 90 to face it toward the collar 97.

A disengaging solenoid 95 is provided and fixed to the spindle support block 29. The solenoid 95 includes a plunger armature 96 movable back and forth along an axis parallel to the spindle 35. The flange 90 fits into and rotationally slides through a slotted portion 99 of the solenoid plunger 96, shown in FIG. 2 in an unenergized condition.

Turning to FIG. 3, there is illustrated the disengagement of the clutch drive mechanism from the spindle 35, wherein the solenoid 95 has been energized to pull the flange 90 axially away from the collar 97, wherein the spring 91 is compressed and one or more slots 94 (only one shown) provided by the bushing portion 92 of the flange 90 is disengaged from a corresponding number of teeth 93 (only one shown) provided by the collar 97. With the solenoid 95 in an actuated condition, the handle 60 can be rotated apart from the bushing portion 92 of the flange 90 to raise or lower the table 10 (FIG. 1). Deactivation of the solenoid 95 returns the collar 97 and the bushing portion 92 to an engaged position due to the biasing action of the spring 91. Where the teeth 93 and the slots 94 are not aligned, such alignment and positive locking engagement will be effected as the bushing portion 92 rotates relative to the collar 93 upon initiating sheet feed to the mechanism.

Turning to FIG. 4, knob 72 is centered within a donut-shaped indicator panel 73 carrying indicia marks for setting the incremental drop increment for each reciprocation of the link 45. Typically, such increments range from 0 to 0.030 inch.

Turning to FIG. 5, the minimum drop distance cam position $d_{min}$ (which could by design be equal to no table drop) is illustrated wherein the distance between the cam follower surface 55 to the center of rotation of the eccentric cam element 80 is greatest. The maximum incremental drop distance cam position $d_{max}$ is provided when the distance between the center of rotation of the eccentric cam element and the cam follower surface 55 is minimal. It can be seen that the smooth, outer peripheral surface 82 of the eccentrically mounted cam element 80 provides a continuous table drop increment adjustment over a predetermined range to accommodate varying thicknesses of sheet material dropped onto the table, as earlier discussed with regard to FIG. 1. Further, the cam element 80 can only rotate in one direction, as indicated in FIG. 1 and as discussed earlier. As the cam follower 54 moves downwardly against the cam element 80, a torque force (illustrated by arrow 85) tends to cause rotation of the cam element 80 in its nonslip position.

What is claimed is:

1. A sheet stacking apparatus comprising:

a sheet-receiving table connected to a spindle means, rotation of the spindle means on its longitudinal axis causing vertical movement of the table;

reciprocating drive means for rotating the spindle means in a first direction by a predetermined amount less than a complete revolution for each reciprocation cycle of the drive means to incrementally lower the table, the drive means including a one-way ratchet-action clutch journaled on the spindle means and a reciprocating lever arm fixed to the clutch and extending radially from the axis of revolution of the spindle means, the clutch translating reciprocating movement of the lever arm into one-way incremental rotational movement of the spindle means;

means for raising the table from a lower position to a higher position; and an adjustment mechanism for establishing the predetermined amount of incremental table lowering, the adjustment mechanism including a cam surface constituted by at least a portion of the outer periphery of at least a partially rotatable cam element and a cam follower means connected to the reciprocating drive means and continuously biased toward the cam surface, rotation of the element varying via the clutch the degree of motion transfer between the reciprocating drive means and the rotating spindle, the throw of the reciprocating drive means being generally constant.

2. An apparatus according to claim 1, wherein the cam follower means is fixed at the distal end of the lever arm and engages the cam surface once for each reciprocation cycle of the drive means.

3. An apparatus according to claim 1, wherein the cam element is rotatable in only one direction.

4. A sheet stacking apparatus comprising:

a horizontal sheet-receiving table suspended by a pair of sprocket engageable chains, the chains extending upward from the table in parallel relation;

a pair of parallel drive shafts located above the table and parallel thereto, one end of the pair of drive shafts including a pair of sprocket gears in engagement with the chains wherein rotation of the shafts vertically moves the table suspended from the chains;

an indexing spindle adjacent the other end of the pair of drive shafts, the indexing spindle being perpendicular to the drive shafts, the other end of the pair of drive shafts including a pair of spur gears engageable with associated worm gears carried on the indexing spindle wherein rotation of the spindle causes rotation of the drive shafts which in turn causes vertical movement of the table;

a one-way, ratchet-action, roller bearing clutch journaled on the indexing spindle, a lever arm fixed to the clutch and extending radially from the axis of rotation of the spindle wherein oscillatory reciprocating-type movement of the lever arm causes incremental rotation of the spindle in one direction to cause incremental lowering of the table;

drive means for imparting reciprocating motion to the lever arm in synchronism with the rate of sheet delivery to the table;

means for raising the table from a lower position to a higher position; and an adjustment mechanism for establishing the increment of table lowering by the indexing spindle, the adjustment mechanism having a movable stop to limit the end travel of the reciprocating lever arm in the slip direction of the one-way clutch wherein movement of the stop varies the increment of rotation of the indexing shaft, the lever arm being continuously spring-biased toward the stop.

5. An apparatus according to claim 4, wherein the stop includes a continuous cam surface constituted by the outer periphery of an element rotatable in only one direction, the distal end of the lever arm providing a cam follower engageable with the cam surface, the cam follower being continuously biased toward the cam surface.

6. An apparatus according to claim 5, wherein the cam follower applies a rotational force to the element opposed to its one-way direction of rotation, the element resisting rotation in the direction of the force applied by the cam follower.

7. A sheet stacking apparatus comprising:

a horizontal sheet-receiving table suspended by a pair of sprocket engageable chains, the chains extending upward from the table in parallel relation;

a pair of parallel drive shafts located above the table and parallel thereto, one end of the pair of drive shafts including a pair of sprocket gears in engagement with the chains wherein rotation of the shafts vertically moves the table suspended from the chains;

an indexing spindle adjacent the other end of the pair of drive shafts, the indexing spindle being perpendicular to the drive shafts, the other end of the pair of drive shafts including a pair of spur gears engageable with associated worm gears carried on the indexing spindle wherein rotation of the spindle causes rotation of the drive shafts which in turn causes vertical movement of the table;

a one-way, ratchet-action, roller bearing clutch journaled on the indexing spindle, a lever arm fixed to the clutch and extending radially from the axis of rotation of the spindle wherein oscillatory reciprocating-type movement of the lever arm causes incremental rotation of the spindle in one direction to cause incremental lowering of the table;

drive means for imparting reciprocating motion to the lever arm in synchronism with the rate of sheet delivery to the table; and means for raising the table from a lower position to a higher position wherein the clutch journaled on the indexing spindle rides on a bushing axially movable along the spindle between a spindle-engaging position and a spindle-disengaging position, the spindle rotating freely in either direction relative to the bushing when located at its spindle-disengaging position, the spindle being rotationally fixed relative to the bushing when at its shaft-engaging position.

8. An apparatus according to claim 7, wherein the spindle carries an axially and rotationally fixed collar interlocking with the bushing at its spindle-engaging position, the collar being axially spaced from the bushing at its spindle-disengaging position.

9. An apparatus according to claim 8, including solenoid means having a linearly movable, armature-type plunger aligned and parallel with the spindle axis of rotation and connected to the bushing, activation of the solenoid moving the bushing to its spindle-disengaging position.

* * * * *